US012698778B2

(12) United States Patent
Malone

(10) Patent No.: US 12,698,778 B2
(45) Date of Patent: Aug. 4, 2026

(54) MULTIPORT FLUID PUMP WITH RESERVE CAPACITY IMPELLER

(71) Applicant: COOPER-STANDARD AUTOMOTIVE INC, Northville, MI (US)

(72) Inventor: David S. Malone, Attica, MI (US)

(73) Assignee: Cooper-Standard Automotive Inc., Northville, MI (US)

( * ) Notice: Subject to any disclaimer, the term of this patent is extended or adjusted under 35 U.S.C. 154(b) by 205 days.

(21) Appl. No.: 17/894,388

(22) Filed: Aug. 24, 2022

(65) Prior Publication Data

US 2024/0068481 A1 Feb. 29, 2024

(51) Int. Cl.

| | |
|---|---|
| ***F04D 15/00*** | (2006.01) |
| ***F04D 1/00*** | (2006.01) |
| ***F04D 29/42*** | (2006.01) |

(52) U.S. Cl.

CPC ..... *F04D 15/0005* (2013.01); *F04D 1/00* (2013.01); *F04D 15/0022* (2013.01); *F04D 29/4246* (2013.01); *F04D 29/4293* (2013.01)

(58) Field of Classification Search

CPC ..... F04D 29/4293; F04D 29/4246; F04D 15/0005; F04D 15/0016; F04D 15/0022; F04D 1/00

See application file for complete search history.

(56) References Cited

U.S. PATENT DOCUMENTS 2,936,745 A * 5/1960 Frank ..... F01P 5/10 123/41.46
3,256,828 A * 6/1966 Clinton ..... F04D 29/669 417/423.11
3,332,234 A * 7/1967 Lavash ..... F02C 7/236 60/39.281

(Continued)

FOREIGN PATENT DOCUMENTS

EP 1819952 B1 10/2010
EP 3529495 B1 3/2022

(Continued)

OTHER PUBLICATIONS

"Centrifugal Pump Selection", 2021.*

(Continued)

*Primary Examiner* — Christopher S Bobish
(74) *Attorney, Agent, or Firm* — Paschall & Associates, LLC; James C. Paschall; Anthony Miologos

(57) ABSTRACT

An apparatus and process for distributing coolant through first and second coolant loops comprising a pump having a first outlet port connected to the first coolant loop and a second outlet port connected to the second coolant loop. A valve switches coolant to the first or second outlet port individually or to the first and second outlet ports concurrently. Coolant pumped by the pump at an unrestricted rate of flow is circulated at a rate of flow less than the unrestricted rate of flow when the valve connects the first outlet port and circulated at a rate of flow less than the unrestricted (Continued)

rate of flow when the valve connects the second outlet port. When the valve connects the first and the second outlet ports concurrently coolant is circulated through the first and the second coolant loops at a rate of flow equal to the unrestricted rate of flow.

10 Claims, 8 Drawing Sheets

(56) References Cited

U.S. PATENT DOCUMENTS

| | | | | |
|---|---|---|---|---|
| 4,091,644 | A * | 5/1978 | Bochan | D06F 39/085 68/184 |
| 4,679,983 | A * | 7/1987 | Pietryk | F04D 29/486 415/152.2 |
| 4,766,852 | A * | 8/1988 | Hirano | F01P 3/22 123/41.21 |
| 5,893,392 | A * | 4/1999 | Spies | F16K 11/0853 251/120 |
| 6,257,177 | B1 * | 7/2001 | Lehmann | F04D 15/0022 417/423.1 |
| 6,681,805 | B2 * | 1/2004 | McLane | F01P 7/167 137/625.16 |
| 6,709,241 | B2 * | 3/2004 | Sabini | F04D 15/0066 417/43 |
| 8,347,831 | B2 * | 1/2013 | Vacca | F16K 11/085 251/304 |
| 8,985,982 | B2 | 3/2015 | Patterson | |
| 9,488,190 | B2 * | 11/2016 | Nuhn | A01C 23/005 |
| 9,903,267 | B2 * | 2/2018 | Robinson | F02B 37/004 |
| 10,570,921 | B2 * | 2/2020 | Geffert | F04D 29/4293 |
| 10,704,453 | B2 * | 7/2020 | Park | F01P 7/14 |
| 11,105,339 | B2 | 8/2021 | Jia et al. | |
| 11,512,712 | B2 * | 11/2022 | Blad | F04D 13/06 |
| 11,525,458 | B2 * | 12/2022 | Hinrichs | F04D 29/426 |
| 11,982,279 | B2 * | 5/2024 | Malone | F04D 29/026 |
| 2014/0286747 | A1 * | 9/2014 | Fang | F04D 15/0016 415/206 |
| 2015/0027575 | A1 * | 1/2015 | Morein | F16K 11/165 137/865 |
| 2020/0263597 | A1 | 8/2020 | Lee | |
| 2021/0003133 | A1 * | 1/2021 | Blad | F04D 29/486 |
| 2023/0400037 | A1 * | 12/2023 | Malone | F04D 29/4293 |

FOREIGN PATENT DOCUMENTS

| | | | |
|---|---|---|---|
| JP | 2014043181 | A | 3/2014 |
| KR | 20200069138 | A | 6/2020 |
| KR | 102359325 | B1 | 2/2022 |
| WO | 2009070565 | A1 | 6/2009 |

OTHER PUBLICATIONS

Search Report and Written Opinion for (PCT/US2023/029769) COO072-WO dated Dec. 6, 2023.
Search Report for 23857907.2 dated Sep. 29, 2025.

* cited by examiner

MULTIPORT FLUID PUMP WITH RESERVE CAPACITY IMPELLER

TECHNICAL FIELD

This disclosure is generally directed to a multiport fluid pump for switching flow to heat generating or absorbing components. More specifically to a multiport fluid pump with integrated valve that has a reserve capacity impeller.

BACKGROUND

Pumps are known and commonly used to move fluids, such as coolant in a vehicle. One example is cooling systems with water pumps, which are used for the cooling of different electrical or mechanical components of a vehicle. In hybrid or purely electric vehicles, electrical components need to be cooled. Valves are used to ensure the distribution of the coolant throughout the cooling system. The valves each require an actuator with electrical control and a holder on a component of the vehicle, which results in high component costs. In some vehicles, more than one cooling loop may be employed to cool heat generating components and to modulate the temperature of the driver cabin. In pumps having multiple output ports that connect a single pump to one or more cooling loops a valve may be used to switch and direct the fluid flow between the one or more cooling loops. Rotating impellers driven by electric motors or by other mechanical means are used by the pump to drive coolant fluid from the pump through the one or more cooling loops. The impeller, housing and outlet ports of the pump are designed to provide a rate of fluid flow based on the rotation of the impeller with a maximum degree of efficiency and a minimum degree of flow restriction. It would be desirable to provide an impeller with reserve capacity to provide the same rate fluid flow through two or more cooling loops as it does to a single cooling loop.

SUMMARY

This disclosure relates to an apparatus for distributing coolant fluid through first and second coolant loops comprising a pump having a housing including an inlet port connected to a source of coolant fluid and a first outlet port connected to the first coolant loop and a second outlet port connected to the second coolant loop. A valve located in the pump housing is switchable to direct coolant fluid from the inlet port to either the first or the second outlet port individually or to the first and second outlet ports concurrently. An impeller located in the pump housing pumps the coolant fluid received from the inlet port at an unrestricted rate of flow. The coolant fluid is circulated through the first coolant loop at a rate of flow less than the unrestricted rate of flow when the valve connects the first outlet port to the first coolant loop and circulated through the second coolant loop at a rate of flow less than the unrestricted rate of flow when the valve connects the second outlet port to the second coolant loop. The coolant fluid is circulated through the first and the second coolant loops at a rate of flow less than the unrestricted rate of flow when the valve connects the first and the second outlet ports concurrently to the first and second coolant loops and which the rates of flow through the first and the second coolant loops jointly equal the unrestricted rate of flow.

This disclosure also relates to a process for distributing coolant fluid through first and second coolant loops comprising pumping coolant fluid from a pump at an unrestricted rate of flow and positioning a valve into a first position to direct the coolant fluid through a first outlet port of the pump connected to the first coolant loop causing the coolant fluid to circulate through the first coolant loop at a rate of flow less than the unrestricted rate of flow. The process further comprises positioning the valve into a second position to direct the coolant fluid through a second outlet port of the pump connected to the second coolant loop, causing the coolant fluid to circulate the coolant fluid through the second coolant loop at a rate of flow less than the unrestricted rate of flow. The process further comprise positioning the valve into a third position to direct the coolant fluid through the first and the second outlet ports concurrently causing the coolant fluid to circulate through each of the first and the second coolant loops at a rate of flow less than the unrestricted rate of flow and that jointly equals the unrestricted rate of flow.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

The figures, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
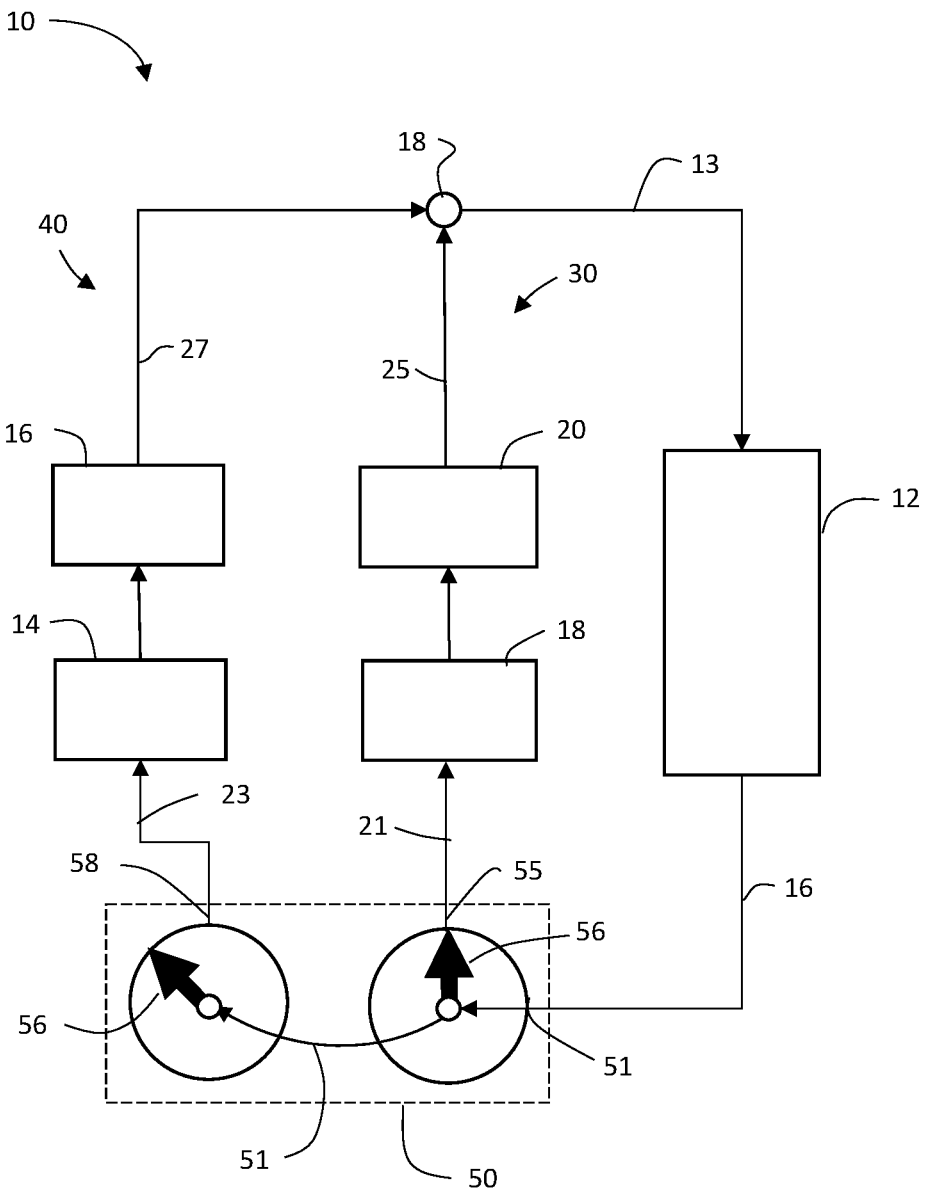
FIG. 1 illustrates a schematic view of a system of the present disclosure.
Figure 2:
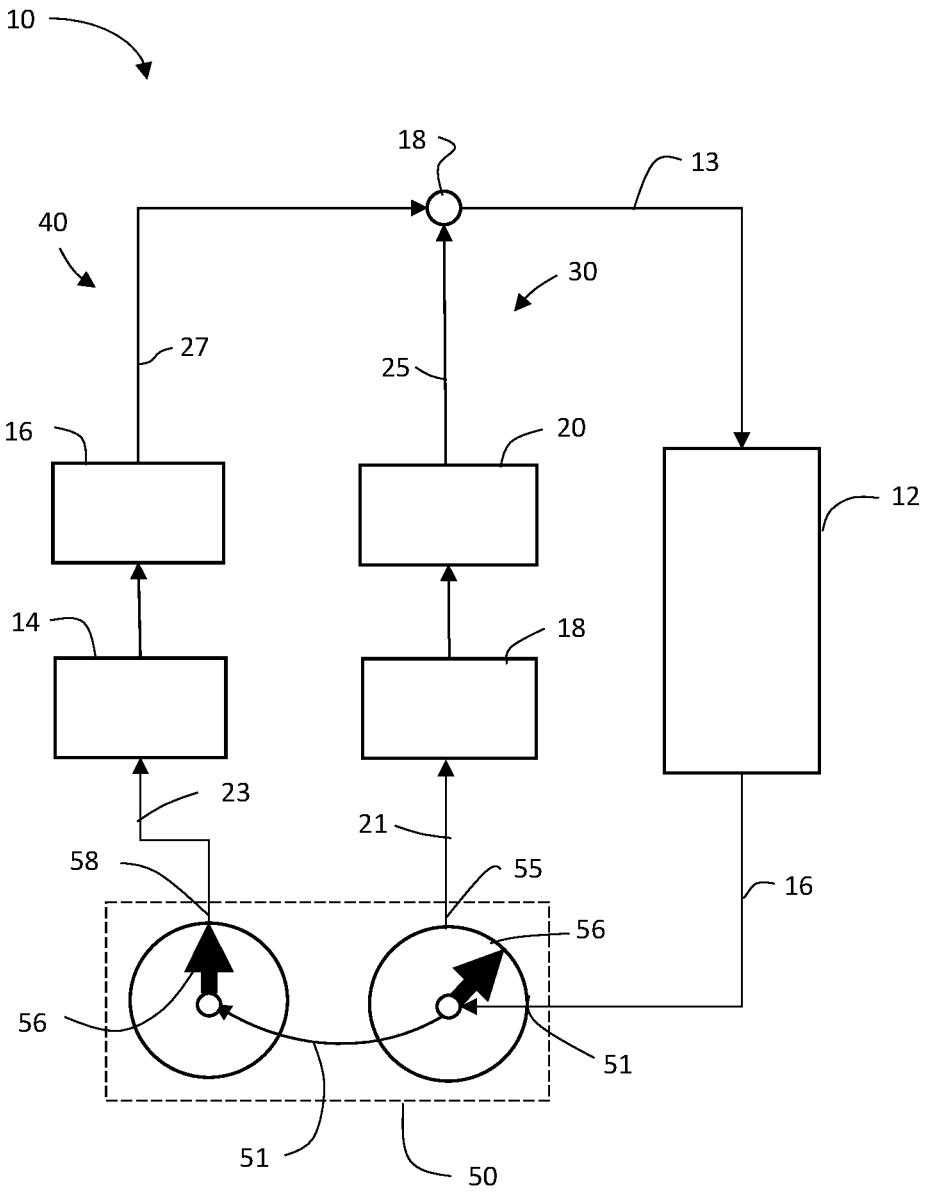
FIG. 2 illustrates a schematic view of a system of the present disclosure.
Figure 3:
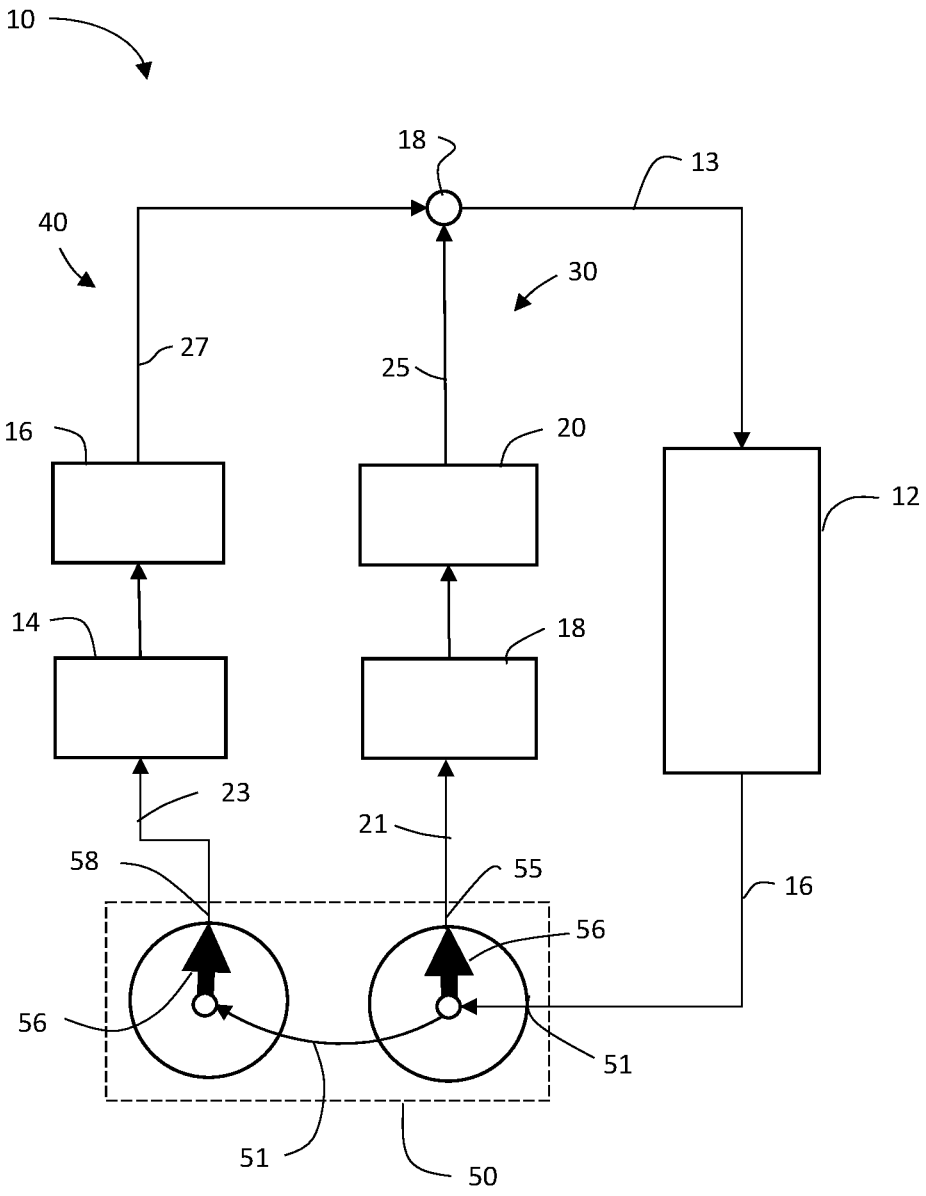
FIG. 3 illustrates a schematic view of a system of the present disclosure.

FIGS. 1-3 depict a system 10 for regulating the temperature of heat generating components of a vehicle. The heat generating components may be those used in a drive unit of the vehicle such as for example a DC to AC inverter 18 and an electrical motor 20 for powering a hybrid or an electrical vehicle. The heat generating components may also be components used in an electrical energy generating unit such as a high voltage to low voltage DC converter 14, and a vehicle battery charger 16. The heat generating components may be organized in the system 10 in separate coolant loops. For example, a first coolant loop 30 containing the heat generating components of the drive components 18, 20 and the second coolant loop 40 containing the high voltage to low voltage DC converter 14, and a vehicle battery charger 16 of the of the energy generating unit.

The first coolant loop 30 containing a coolant fluid is fluidically connected to a heat dissipating device 12 such as for example, a heat exchanger or a radiator that uses an electrically or mechanically driven fan to provide the transfer of heat from the coolant by directing air at an ambient temperature over the heat dissipating device 12. The heat dissipating device 12 removes the heat absorbed by the coolant fluid from the heat generating components. A second coolant loop 40 containing coolant fluid fluidically connects the energy generating components 14, 16 to the heat dissipating device 12 through junction 18. The first and second loops 30 and 40 are both connected to an electrically driven pump 50. The pump 50 includes a suction inlet port 51 fluidically connected to fluid line 16 from the heat dissipating device 12. The inlet port 51 receives the coolant fluid from the heat dissipating device 12 and pumps the coolant fluid through loops 30 and 40. The pump 50 further includes two outlet ports 55 and 58. Outlet port 55 provides a fluid outlet from the pump 50 to fluid line 21 of coolant loop 30 and outlet port 58 provides a separate fluid outlet to fluid line 23 of coolant loop 40. A valve 56 installed is installed in pump 50 is movable to switch the flow of coolant fluid from the outlet ports.

For example, in FIG. 1, the valve 56 is switched into a first position that provides a fluid path from inlet port 51 to outlet port 55 fluidically connecting coolant loop 30 and the heat generating components 18, 20 to the heat dissipating device 12. In the first position the valve blocks outlet port 58 isolating coolant loop 40 from the heat dissipating device 12. The coolant fluid from the pump 50 flows from outlet 55 to the drive unit heat generating components 18, 20 through fluid line 25, junction 18 and return line 13 to the heat dissipating unit 12.

In FIG. 2, the valve 56 is switched into a second position that provides a fluid path from inlet port 51 to outlet port 58 fluidically connecting coolant loop 40 and the heat generating components 14, 16 of the energy generating unit to the heat dissipating device 12. In the second position the valve blocks outlet port 55 isolating coolant loop 30 from the heat dissipating device 12. The coolant fluid from the pump 50 flows from outlet port 58 to the energy generating unit components 14, 16 through fluid line 27, junction 18 and return line 13 to the heat dissipating unit 12.

In FIG. 3, the valve 56 is switched into a third position that provides a fluid path from inlet port 51 to both outlet ports 55 and 58 concurrently that fluidically connects both coolant loop 30 and coolant loop 40 to the heat dissipating device 12. In the third position the rate of flow of coolant fluid generated by the pump 50 is shared between outlet ports 55 and 58. The coolant fluid from the pump 50 is pumped to both outlet ports 55 and 58 to loops 30 and 40.

It is a practiced art in pump design to define a rate of flow that a pump can produce at a setpoint RPM produced by the motor driving the pump. The geometric design of pump impeller and the outlet port housing/volute area work in conjunction with the setpoint RPM to achieve a desired rate of flow from the pump without flow restriction. Flow restriction causes an inefficient use of the energy due to the impeller spinning throttled fluid that does not exit the pump. An oversized impeller used within a restricted pump housing or with an outlet port having a small diameter or outlet area results in a geometric restriction and a throttled rate of flow.

For example, if the interior housing volume of the pump housing and of the outlet ports surrounding an impeller are too small for a setpoint RPM, the rate of flow at a setpoint RPM will be restricted and the full rate of flow that the impeller has the capacity to produce will not exit the outlet. The solution to such a restriction in flow would be to increase the housing volume or reduce the impeller geometry, such as for example the impeller outside diameter to provide a more efficient rate of flow.

However, an impeller design that lends itself to a non-restricted and efficient rate of flow for a one outlet pump, does not provide a sufficient rate of flow in a switched multiport pump when two or more outlet ports are open in the pump. A pump design having an impeller optimally designed to provide an efficient rate of flow for a pump having one outlet port would produce a fractional rate of flow for a pump having two or more open outlet ports.

For example, sizing the impeller to have twice the capacity as allowed by outlet volume formed by the housing and a single outlet port opening results in a restricted or throttled impeller capacity ($\varphi_{restriction}$=Restriction Factor). In this example, the inlet flow rate is half the impeller flow capacity ($\varphi_{restriction}=2$ or $Q_{impeller}/2$). Likewise, the outlet rate of flow, less any minor losses, trails the inlet flow and is also half the impeller capacity ($Q_{impeller}/2$). The factor of 2 is shown for convenience only.

Where:

$Q_{impeller}$=Impeller Capacity $Q_{inlet}=Q_{impeller}/\varphi_{restriction}$ $Q_{youtlet}=Q_{impeller}/\varphi_{restriction}$ For a pump that has multiple switched outlet ports it is advantageous to oversize the impeller for a single outlet port setpoint RPM, in order to provide an equal amount of a rate of flow when two or more outlet ports are open. For example, using an impeller that has twice the capacity as allowed by outlet volume formed by the housing and a single outlet port results in a restricted or throttled impeller capacity as shown above. However, when the switched pump opens two or more outlet ports the impeller capacity is no longer throttled. This results in the full unrestricted impeller capacity to be realized at the same setpoint RPM. The inlet capacity increases to match the outlet capacity ($Q_{inlet}=Q_{impeller}$ The resulting outlet rate of flow to both open outlet ports follows the impeller capacity divided by the number of outlets ($n_{outlets}$) or ($Q_{x\text{-}outlet}=Q_{impeller}/n_{outlets}$ and $Q_{y\text{-}outlet}=Q_{impeller}/n_{outlets}$). For convenience two outlets are shown for this example ($n_{outlets}=2$).

Where:

$Q_{impeller}$=Impeller Capacity $Q_{inlet}=Q_{impeller}$ $Q_{x\text{-}outlet}=Q_{impeller}/n_{outlets}$ $Q_{y\text{-}outlet}=Q_{impeller}/n_{outlets}$ This results in the full unrestricted impeller capacity to be used at the same setpoint RPM and where the inlet capacity equals the impeller capacity. Therefore, it is advantageous in a switched pump to design the impeller to be restricted when only one outlet port is open in order to provide a reserve capacity when two or more outlet ports are open.

Figure 4:
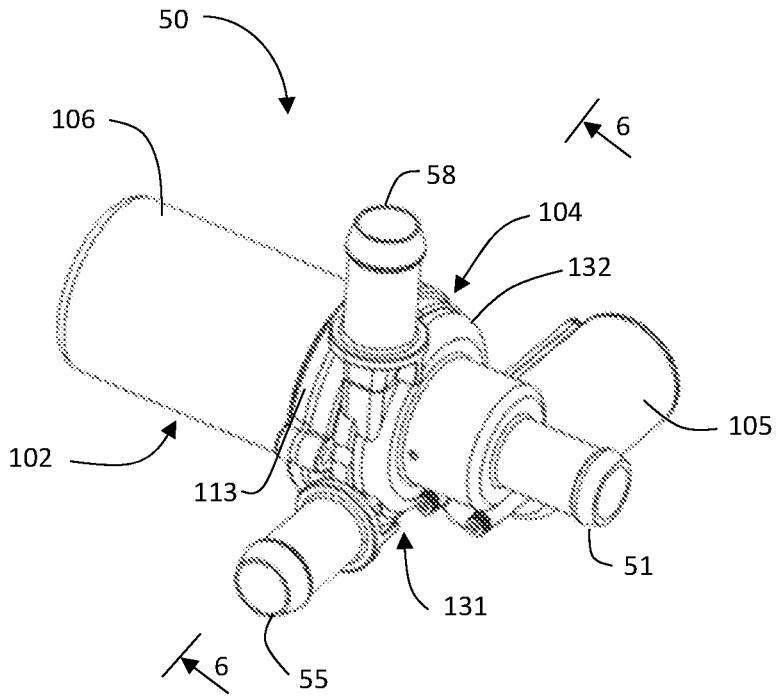
FIG. 4 illustrates an isometric view of a pump of the present disclosure.

FIG. 4 illustrates an example of a switched pump 50 for pumping the coolant fluid in system 10. As can be appreciated, the pump 50 may be used in a vehicle and also can be used in non-vehicle applications. The pump 50 is an integration of a pump and a valve for selectively controlling the flow of coolant fluid from the pump. The pump 50 includes a pump motor section 102 and a pump section 104. The pump motor section 102 includes a motor housing 106.

Figure 5:
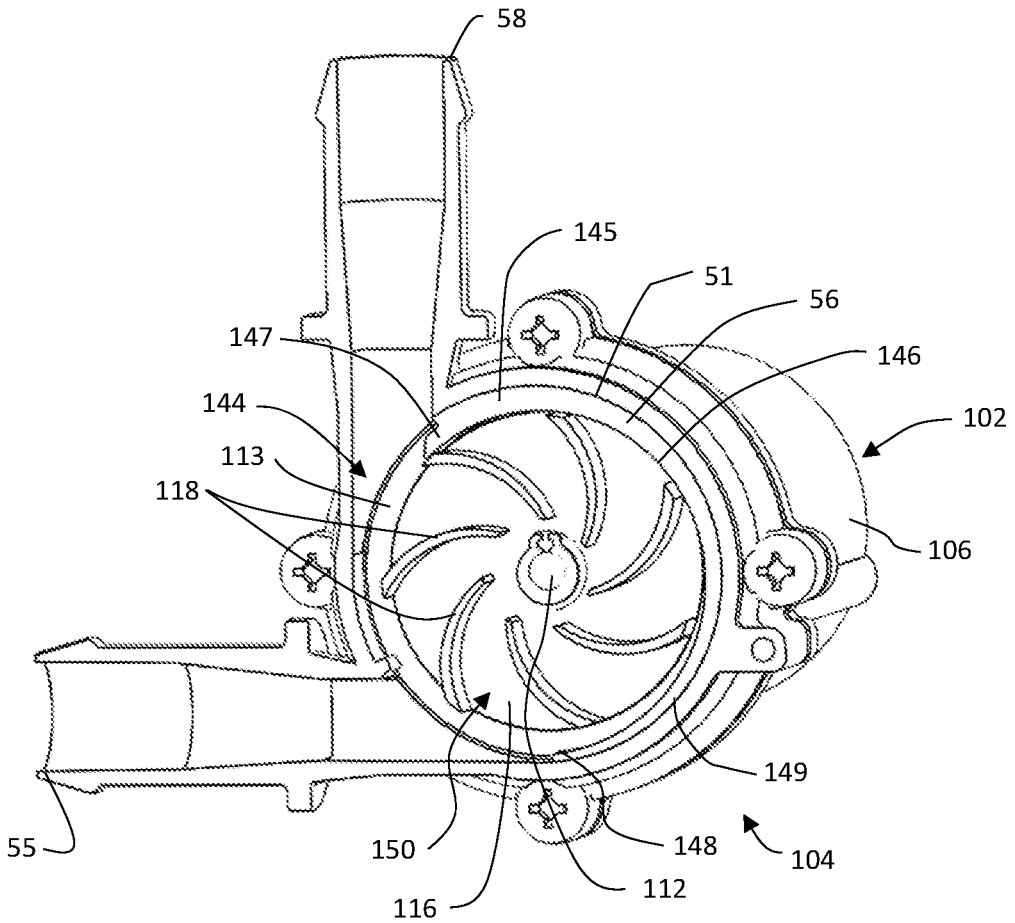
FIG. 5 illustrates an isometric sectional view through the valve member of the pump of FIG. 4 taken at segment 6-6.

FIG. 5 illustrates a cross-sectional perspective view of the pump section 104 taken at segment 6-6 of FIG. 5. The pump motor housing 106 contains a pump motor (not shown) and a motor shaft 112 is installed through an opening of a pump motor mounting plate 113. The pump motor drives an impeller 116 to move the coolant fluid. The impeller 116 includes a plurality of impeller vanes 118 for moving the coolant fluid from the inlet to the outlets. The impeller 116 is configured to be rotatable within the pump section 104 driven by the motor shaft 112. The pump motor includes electrical connections (not shown) that are adapted to receive electrical power from a remotely located power source to energize and operate the pump motor.

In FIG. 4, the pump housing 131 of pump section 104 is formed essentially cylindrically and comprises a peripheral exterior wall 132. An inlet port 51, for example a suction inlet for sucking in the coolant fluid, is positioned centrally to the rotary axis of the pump housing 131. The pump housing 131 also includes at least two outlet ports for discharging the coolant fluid from the pump section 104. In this embodiment, a first outlet port 55 and a second outlet port 58 are shown. The first outlet port 55 and the second outlet port 58 extend from the wall 132 and are axially offset from each other such that the centers of the outlet ports 55, 58 in the example, are oriented 90 degrees from the other. It will be appreciated by those skilled in the art, that outlet ports 55, 58 may be offset from each other at any other convenient angle. A valve actuator may be housed in an actuator housing 105.

Referring to FIG. 5, the outlet ports 55 and 58, are in downstream communication with a pump cavity 150. An adjustable valve member 56 is radially located outside the impeller 116 and inside the pump cavity 150. The valve member 56 is arranged to adjustably direct the coolant fluid through the respective outlet ports 55, 58. The valve member 56 has an annular wall 145 with an exterior wall surface 149 and an interior wall surface 146 and an opening 144 extending through wall 145. In this example, wall 145 of the valve member 56 is spirally voluted from a generally thicker wall section at a first end 147 of opening 144 to a generally thinner wall section at a second end 148 of the opening 144. The impeller 116 is arranged to rotate inside the annular wall 145 and particularly the voluted interior wall surface 146 at a setpoint RPM.

In operation, rotation of the valve member 142 selectively switch opening 144 to divert coolant fluid from the pump cavity 150 to the first outlet port 55, to the second outlet port 58 or to both outlet ports 55, 58 concurrently, thereby controlling the discharge of coolant fluid from the pump section 104.

Figure 6:
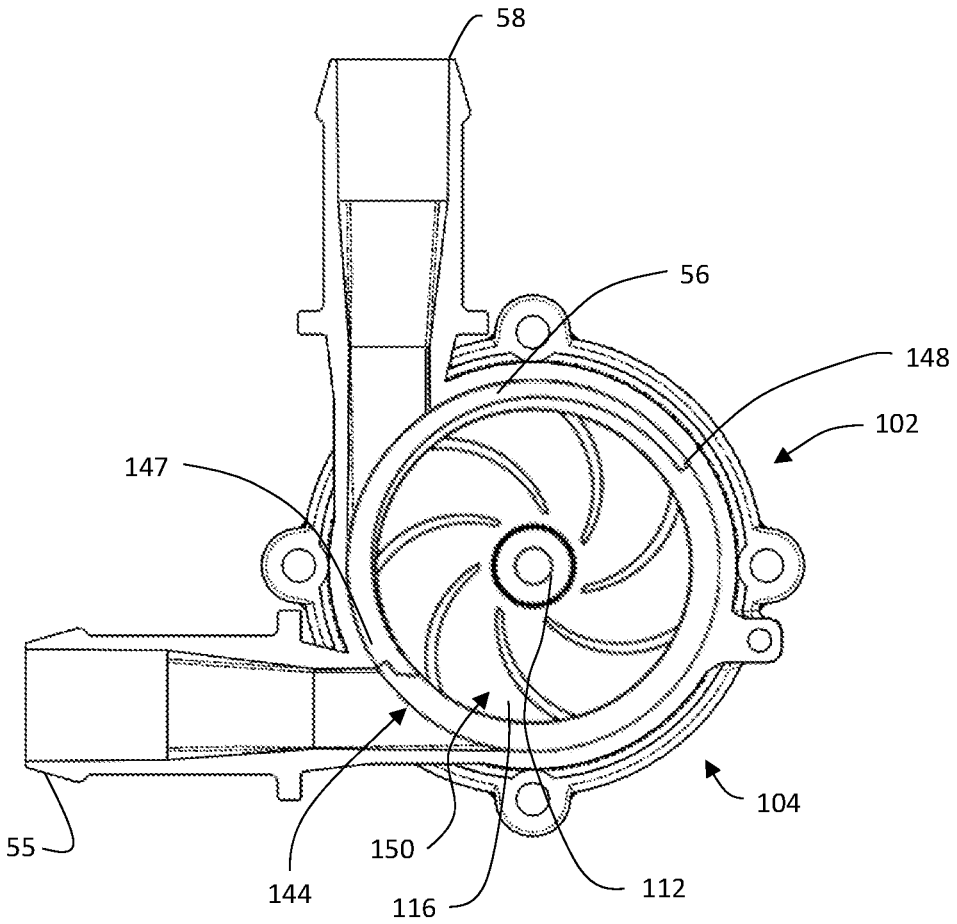
FIG. 6 illustrates a sectional view through the pump with the valve member in the first position taken at segment 6-6 of FIG. 4.
Figure 7:
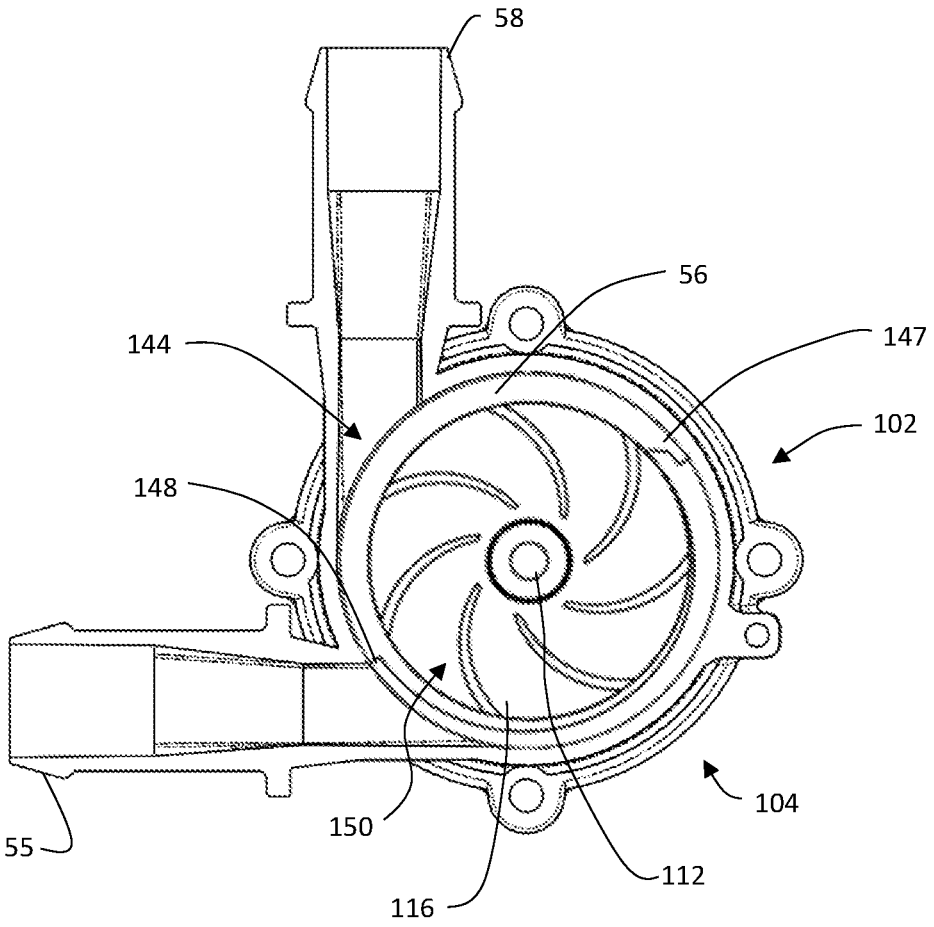
FIG. 7 illustrates a sectional view through the pump with the valve member in the second position taken at segment 6-6 of FIG. 4.
Figure 8:
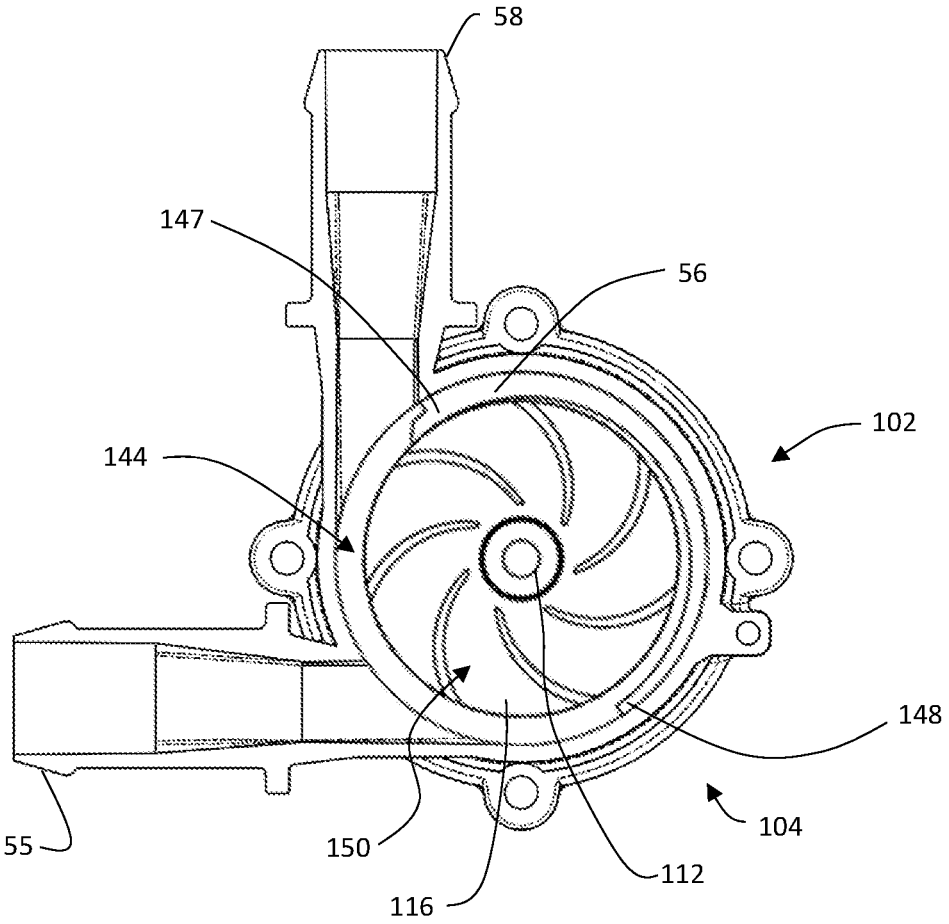
FIG. 8 illustrates a sectional view through the pump with the valve member in the third position taken at segment 6-6 of FIG. 4.

FIGS. 6-8, illustrate the operation of the valve member 56 to direct flow from the pump cavity 150 to the outlet ports 55, 58. FIGS. 6-8 show the mechanical position of the valve 56 within valve 50 when the actuator rotates the valve member 56 to switch-in or switch-out an outlet port 55, 58. As is shown in FIG. 6, the impeller 116 rotates within the pump cavity 150 and inside of valve member 56. The impeller is driven at a designed setpoint RPM by the pump motor 10. The pump cavity 150 receives coolant fluid from fluid line 16 from pump inlet port 51. The impeller 116 and vanes 118 drive the fluid from the pump cavity 150 to the one or more outlet ports 55, 58 according to the position of opening 144. For example, in FIG. 6 the actuator rotates the valve member 56 to the first position switching opening 144 into alignment with the outlet port 55 providing a fluid path through the pump 50 from the inlet port 51 and pump cavity 150 to outlet port 55. In the first position, wall 145 of the valve member 56 closes fluid outlet port 58. In the first position fluid driven by the impeller 116 is routed entirely through opening 144 of valve member 56 to outlet port 55. With renewed reference to FIG. 1, the valve member 56 when rotated to the first position fluidically connects outlet port 55 to fluid line 21 and coolant loop 30 isolating coolant from flowing into fluid line 23 and coolant loop 40.

FIG. 7 illustrates the valve member 56 positioned in the second position, where, the actuator rotates the valve member 56 to switch opening 144 into alignment with outlet port 58. This causes coolant fluid driven by the impeller 116 to be routed entirely through opening 144 of valve member 56 to fluid outlet 58. With renewed reference to FIG. 2, the valve member 56 switched to the second position, fluidically connects outlet port 58 to fluid line 23 and coolant loop 40, isolating fluid flow to fluid line 21 and coolant loop 30.

As was explained above the impeller 116 is designed to have twice the capacity as allowed by outlet volume formed by the housing and each single port opening of outlets 55, 58. This results in a restricted or throttled impeller capacity ($\varphi_{restriction}$=Restriction Factor). In the example explained earlier, the inlet flow rate is half the impeller flow capacity ($\varphi_{restriction}$=2 or $Q_{impeller}/2$). Likewise, the outlet flow, less any minor losses, trails the inlet flow and is also half the impeller capacity ($Q_{impeller}/2$). For example, the impeller 116 is designed to provide a 100 liters per minute (lpm) of a rate of flow at a setpoint of 5000 RPM. This is the maximum efficient flow rate for the impeller 116. However, as explained earlier, the pump 50 throttles or restricts flow rate when only one of the two available outlet ports is switched into operation. Switching the valve member 56 in either the first or the second position the rate of flow is throttled achieving a rate of flow of 50 liters per minute (lpm), or approximately half of its designed rate of flow from any one of the fluid outlets 55, 58 ($Q_{x\text{-}outlet}$ or $Q_{y\text{-}outlet}$).

Where:

Wrpmsetpoint=5000 rpm
Qimpeller=100 lpm
Qinlet=50 lpm
Qx-outlet or Qy-outlet=50 lpm The impeller 116 has the capacity to produce a rate of flow of 100 lpm, however when only one of the two fluid outlets is open, a throttled rate of flow of 50 lpm is output from any one of the individually open fluid outlet 55, 58 and therefore the impeller 116 has a reserve capacity of 50 lpm.

Switching the valve 56 by the actuator into the third position is shown in FIG. 8 and in the flow schematic drawing of FIG. 3. In the third position, opening 144 is aligned with both outlet ports 55, 58 concurrently, providing coolant fluid from the pump cavity 150 driven by impeller 116 to both fluid lines 21, 23 and to both coolant loops 30 and 40. With a constant impeller rotation of 5000 RPM and applying the formula derived earlier, the impeller now provides its designed reserve flow capacity, shared between coolant loop 30 and coolant loop 40.

Where:

Wrpmsetpoint=5000 rpm
Qimpeller=100 lpm
Qinlet=100 lpm
Qx-outlet and Qy-outlet=50 lpm Thereby using the reserve capacity to provide an equal rate of flow through each of the loops 30 and 40.

It will be appreciated by those skilled in the art that an impeller 116 can be designed to provide a reserve capacity impeller to maintain an equal rate of flow from pumps having three or more switched outlet ports at a setpoint RPM. For example, when the pump impeller is sized by design to have a rate of flow that is unrestricted or not-throttled by the housing, volute volume and fluid outlet in a dual flow mode, e.g. a first and a second outlet port open of a three outlet port pump, the simultaneous rate of flow is the sum of both rates of flow from the two open outlet ports, which will be equal to the rate of flow at the pump inlet port, which is in turn, is equal to the impeller flow capacity at the rpm setpoint. When the valve of the pump is switched to only one open port, e.g., third outlet port open and the first and second outlet ports closed, the rate of flow will be a flow rate that is equal to the rate of flow through either of the two previously open outlet ports with the inlet being half of the impeller capacity.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," or "controller" within a claim is understood and intended to refer to structures known to those skilled in the relevant art, as further modified or enhanced by the features of the claims themselves and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus for distributing coolant fluid through first and second coolant loops comprising:

a pump having a housing including an inlet port connected to a source of coolant fluid and a first outlet port connected to the first coolant loop and a second outlet port connected to the second coolant loop the second outlet port offset at an angular orientation relative to the first outlet port;

a valve located in the pump housing having a wall and an opening extending through the wall, wherein an interior surface of the wall is spirally voluted from a thicker wall section at a first end of the opening to a thinner wall section at a second end of the opening, the valve switchable to align the wall or the opening at the first outlet port or the second outlet port to direct coolant fluid from the inlet port to either the first or the second outlet port individually or the first and second outlet ports concurrently; and an impeller located in the pump housing that has an impeller capacity equal to an inlet port capacity and which rotates at a setpoint RPM that pumps the coolant fluid received from the inlet port at an unrestricted rate of flow, wherein, the coolant fluid is circulated through the first coolant loop at a rate of flow less than the unrestricted rate of flow at the setpoint RPM when the valve opening connects the first outlet port to the first coolant loop and the wall blocks the second outlet port disconnecting the second outlet port from the second coolant loop; and the coolant fluid is circulated through the second coolant loop at a rate of flow less than the unrestricted rate of flow at the setpoint RPM when the valve opening connects the second outlet port to the second coolant loop and the wall blocks the first outlet port disconnecting the first outlet port from the first coolant loop; and the coolant fluid is circulated through the first and the second coolant loops at the unrestricted rate of flow at the setpoint RPM when the valve opening connects the first and the second outlet ports concurrently to the first and second coolant loops.

2. The apparatus of claim 1, wherein the pump includes a motor connected to the impeller, the motor arranged to rotate the impeller at the setpoint RPM.

3. The apparatus of claim 1, wherein the impeller is located in the pump housing between the inlet port and the valve.

4. The apparatus of claim 2, wherein the pump inlet port is connected to a heat dissipating device that supplies the source of coolant fluid.

5. The apparatus of claim 4, wherein the heat dissipating device is fluidically connected to the first coolant loop and the second coolant loop.

6. The apparatus of claim 5, wherein the first coolant loop includes at least one heat generating component and the pump circulates coolant fluid through the first outlet port to the at least one heat generating component in the first coolant loop and to the heat dissipating device.

7. The apparatus of claim 5, wherein the second coolant loop includes at least one heat generating component and the pump circulates coolant fluid through the second outlet port to the at least one heat generating component of the second coolant loop and the heat dissipating device.

8. The apparatus of claim 1, wherein the impeller pumps the coolant fluid at the unrestricted rate of flow that is greater than the rate of flow applied through the first outlet port and circulated through the first coolant loop, wherein the rate of flow of the coolant fluid returned to the inlet port is less than the unrestricted rate of flow produced by the impeller at the setpoint RPM.

9. The apparatus of claim 1, wherein the impeller pumps the coolant fluid at the unrestricted rate of flow that is greater than the rate of flow applied through the second outlet port and circulated through the second coolant loop, wherein the rate of flow of the coolant fluid returned to the inlet port is less than the unrestricted rate of flow produced by the impeller at the setpoint RPM.

10. The apparatus of claim 1, wherein the pump impeller pumps the coolant fluid at the unrestricted rate of flow that is greater than the rate of flow applied to the first and the second outlet ports concurrently and circulated through the first and the second coolant loops, wherein the rate of flow of the coolant fluid returned to the inlet port is equal to the unrestricted rate of flow produced by the impeller at the setpoint RPM.

* * * * *